US007950919B2

(12) United States Patent
Johnson et al.

(10) Patent No.: US 7,950,919 B2
(45) Date of Patent: May 31, 2011

(54) METHOD AND APPARATUS FOR MONITORING AND CONTROLLING THE STABILITY OF A BURNER OF A FIRED HEATER

(75) Inventors: Gregory Lynn Johnson, Houston, TX (US); William Larry Hamilton, Houston, TX (US)

(73) Assignee: Shell Oil Company, Houston, TX (US)

( * ) Notice: Subject to any disclaimer, the term of this patent is extended or adjusted under 35 U.S.C. 154(b) by 1386 days.

(21) Appl. No.: 11/248,398

(22) Filed: Oct. 12, 2005

(65) Prior Publication Data

US 2006/0084018 A1 Apr. 20, 2006

Related U.S. Application Data

(60) Provisional application No. 60/618,909, filed on Oct. 14, 2004.

(51) Int. Cl.
*F23N 3/02* (2006.01)
*F23N 5/00* (2006.01)

(52) U.S. Cl. ..... 431/12; 431/19; 431/20; 431/75

(58) Field of Classification Search ..... 431/12, 431/19, 20, 75

See application file for complete search history.

(56) References Cited

U.S. PATENT DOCUMENTS 4,004,875 A * 1/1977 Zink et al. ..... 431/9
4,080,151 A * 3/1978 Reed et al. ..... 431/13
4,251,025 A * 2/1981 Bonne et al. ..... 236/14
4,253,404 A * 3/1981 Leonard ..... 110/188

(Continued)

FOREIGN PATENT DOCUMENTS

DE 102 04 264 A1 7/2003

(Continued)

OTHER PUBLICATIONS

Statistical characteristics of pressure oscillations in a premixed combustor, Journal of Sound and Vibration 260 (2003), pp. 3-17, Tim C. Lieuwen, School of Aevospace Engineeving, Geovgia Institute of Technology, Atlanta, GA 30332-0150, USA Received Jan. 29, 2001; accepted Mar. 25, 2002, www.elsevier.com/locate/j svi.*

(Continued)

*Primary Examiner* — Carl D Price
(74) *Attorney, Agent, or Firm* — William E. Hickman

(57) ABSTRACT

The invention includes method and apparatus for controlling the stability of a burner, preferably a low $NO_x$ burner, of a natural draft heater. The method includes measuring the draft over a time period and generating a measured output from which a draft function is determined that defines the relationship between the draft and time during the time period. A value for the burner stability is defined that is representative of a stable burner operation. The draft function is compared to the stable burner value to determine a differential value, and the operation of the fired heater is adjusted in response to the differential value. The apparatus includes means for measuring the draft over a time period and means for generating a measured output from which a draft function is determined that is proportional to the cyclic variation of the draft during the time period. Further included is means for comparing the draft function to a defined burner stability value representative of a stable burner operation to determine a differential value and means for adjusting the operation of the fired heater in response to the differential value.

17 Claims, 2 Drawing Sheets

U.S. PATENT DOCUMENTS

| | | | | | |
|---|---|---|---|---|---|
| 4,257,763 | A | * | 3/1981 | Reed | 431/188 |
| 4,262,843 | A | | 4/1981 | Omori et al. | 236/15 C |
| 4,300,399 | A | * | 11/1981 | Kuijpers et al. | 73/861.04 |
| 4,347,052 | A | * | 8/1982 | Reed et al. | 431/188 |
| 4,347,747 | A | * | 9/1982 | Krishnaswamy | 73/861.18 |
| 4,411,235 | A | * | 10/1983 | Shinoda et al. | 123/488 |
| 4,574,746 | A | | 3/1986 | Keyes, IV et al. | 122/448 S |
| 5,073,105 | A | * | 12/1991 | Martin et al. | 431/116 |
| 6,422,858 | B1 | * | 7/2002 | Chung et al. | 431/8 |
| 6,616,442 | B2 | * | 9/2003 | Venizelos et al. | 431/8 |
| 7,089,746 | B2 | * | 8/2006 | Lieuwen et al. | 60/779 |
| 7,136,794 | B1 | * | 11/2006 | Bechhoefer | 703/7 |
| 7,353,140 | B2 | * | 4/2008 | Daw et al. | 702/182 |
| 2004/0033457 | A1 | * | 2/2004 | Zhang et al. | 431/79 |
| 2006/0042261 | A1 | * | 3/2006 | Taware et al. | 60/773 |

FOREIGN PATENT DOCUMENTS

| | | | | |
|---|---|---|---|---|
| EP | 0448202 | A1 | | 2/1991 |
| EP | 1351019 | A2 | | 10/2003 |
| GB | 2027231 | A | * | 2/1980 |
| JP | 57134618 | A | * | 8/1982 |
| JP | 59032713 | A | * | 2/1984 |
| JP | 59137717 | A | * | 8/1984 |
| JP | 59164820 | A | * | 9/1984 |
| JP | 07071884 | A | * | 3/1995 |
| JP | 08-152345 | | * | 6/1996 |
| JP | 09303756 | A | * | 11/1997 |
| JP | 09-229337 | | * | 1/1999 |
| JP | 11-02243 | | * | 1/1999 |

OTHER PUBLICATIONS

English language translation, JP 59137717 Thermal Power Plant Control Method [Karyoku puranto no seigyo hoho] Akira Sugano, et al., pp. 1-19, Date: Aug. 7, 1984.*

English language translation, JP 57134618 Control System of Pressure in the Furnace of Thermal Power Plant [Karyoku puranto no ronai atsuryoku seigyo hoshiki] pp. 1-13 Akira Sugano et al., Date:Aug. 19, 1982.*

International Search Report of PCT/US2005/036565 of Feb. 9, 2006.

Written Opinion of PCT/US2005/036565 of Feb. 9, 2006.

* cited by examiner

METHOD AND APPARATUS FOR MONITORING AND CONTROLLING THE STABILITY OF A BURNER OF A FIRED HEATER

This application claims the benefit of U.S. Provisional Application No. 60/618,909, filed Oct. 14, 2004.

This invention relates to a method and apparatus for monitoring and controlling the stability of a burner of a fired heater.

As a result of environmental standards relating to limitations on the atmospheric release of nitrogen oxides ($NO_x$), industry has been equipping many of its process heating furnaces and boilers with low $NO_x$ burners in order to reduce $NO_x$ emissions. Low $NO_x$ burners are specially designed to provide for the combustion of fuels with a low yield and release of $NO_x$. One method by which the low $NO_x$ burners achieve this is through burner designs that provide for firing with low excess of air so as to limit the amount of oxygen that is available to the fuel gas at the tips of the burner. This limitation of available oxygen provides for a lower combustion temperature, a slower fuel burn rate, and an extended flame front that produces less $NO_x$.

One problem that has been discovered with the use of low $NO_x$ burners in natural draft furnaces is that the operation of the burner is less stable than other conventional types of burners. This instability can and sometimes does under certain operating conditions result in the flame of the low $NO_x$ burner to blow or flame-out. This flame-out condition can result in process operating disruptions and is dangerous due to the explosion potential. There are various methods for detecting when the flame of a burner has blown out, but there are no satisfactory methods for predicting when the flame of a burner is about to blow out so as to allow for remedial action to prevent such an event. Moreover, flame detection in natural draft process heaters is expensive, and unreliable, and, while not widely practiced, it can be desirable to find reliable and economical methods of monitoring flame conditions of burners in natural draft heaters.

Accordingly, an object of the invention is to provide a method and apparatus for monitoring the operation of a process heater so as to predict the potential or imminent flame-out of its burners.

Another object of the invention is to provide a method and apparatus for controlling the operation of the burners of a furnace so as to prevent burner flame-out.

In accordance with the invention, a method is provided for controlling the stability of a burner of a fired heater operated to provide a draft. The method includes measuring the draft over a time period and generating a measured output from which a draft function is determined that defines the relationship between the draft and time during the time period. A burner stability value is defined that is representative of a stable burner operation. The draft function is compared to the burner stability value and the operation of the fired heater is adjusted in response to a difference between the draft function and burner stability value.

In accordance with another invention, an apparatus is provided for controlling the stability of a burner of a fired heater operated to provide a draft. The apparatus includes means for measuring the draft over a time period and means for generating a measured output from which a draft function is determined that defines the relationship between the draft and time during the time period. Further included is means for comparing the draft function to a defined burner stability value representative of a stable burner operation to determine a deviation from stable operation and means for adjusting the operation of the fired heater in response to the deviation value.

Figure 1:
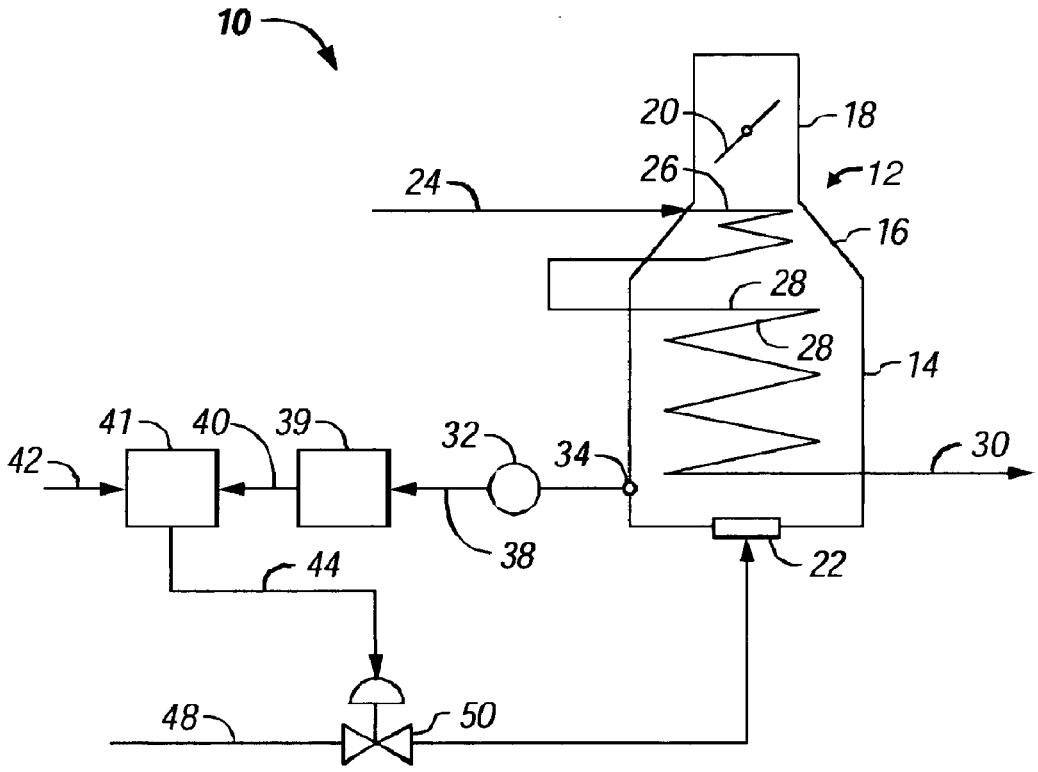
FIG. 1 is a schematic representation of a fired heater equipped with at least one burner and a monitoring and control system.

This invention relates to method and apparatus for monitoring the stability of a burner or burners of a fired heater and, further, it relates to the control or operation of the fired heater or of the burners of the fired heater in order to maintain burner stability so as to prevent burner flame-out.

The fired heater of the apparatus and control method can be any conventional fired heater or boiler known to those skilled in the art. One particular type of fired heater contemplated by the invention is a natural draft fired heater that utilizes the draft created by the density differential of the hot combustion gases of the fired heater and the cooler outside air at the top of the fired heater stack. Generally, a natural draft fired heater includes a radiant section, a convection section and a stack. The radiant section of the fired heater is equipped with one or more burners each of which defines a combustion zone and provides means for burning a fuel such as a hydrocarbon gas or hydrocarbon liquid. The burner may be operatively placed in the bottom floor or in the wall of the radiant section of the fired heater.

In the combustion of hydrocarbons with air as the oxygen source by a burner of a fired heater the nitrogen oxides ($NO_x$) of nitric oxide (NO) and nitrogen dioxide ($NO_2$) are formed. The nitrogen oxides are formed primarily in the high temperature zone of the fired furnace where sufficient concentrations of nitrogen and oxygen are present. Due to environmental concerns, it is desirable to reduce the amount of $NO_x$ formed in the operation of a fired heater, and there are a variety of techniques by which this is accomplished. One such approach is the use of newer burner designs and burner technologies that provide for the low yield of $NO_x$ in the combustion of hydrocarbons.

When compared to conventional burners, the so-called low $NO_x$ burners provide in their use for a reduced formation of $NO_x$. One of the ways by which these low $NO_x$ burners do this is by providing for the limitation of oxygen that is available to the fuel gas at the tips of the burner or providing for a low amount of excess air in the combustion of the fuel gas. Various types of low $NO_x$ burners have been described in the patent art in, for example, U.S. Pat. Nos. 4,004,875; 4,257,763; 4,347,052; 5,073,105; 6,422,858; and 6,616,442. These patent publications are hereby incorporated herein by reference.

One problem associated with the use of low $NO_x$ burners in fired heaters and, in particular, in natural draft fired heaters is that the low excess of air used in the combustion of the fuel results in a less stable burner operation. This reduced stability can often result in flame-out situations during the operation of the fired heater equipped with the low $NO_x$ burner. A flame-out situation can be both disruptive to the operation of the process associated with the fired heater and dangerous. It is, thus, desirable to be able to predict when a flame-out situation is imminent in order to take remedial action to prevent it.

It has been discovered that in the operation of natural draft fired heaters that are equipped with low $NO_x$ burners there are certain operating conditions or characteristics that can be predictive of a possible or imminent flame-out of the burners. Specifically, the characteristic operating condition found to be predictive of an imminent flame-out is the frequency at which the draft of the fired heater oscillates per unit of time and the amplitude of the fluctuation of the draft. As used herein, the term "draft" is defined as the pressure differential between the pressure at the bottom floor of the fired heater that utilizes the low $NO_x$ burner and atmospheric pressure.

During the operation of a fired heater that is equipped with a burner, the heater draft can be measured during a specified time period. From this measured value, the functional relationship between the change in draft and a given time period can be determined. As noted above, it has been discovered that the stability of the burner can be predicted by observing the frequency at which the draft changes and the amplitude of such changes. This relationship is referred to herein as the "draft function".

The stability determination of a burner of a fired heater may be specific to the particular equipment and equipment configuration, but, in general, it has been found that, when the draft function is such that the heater draft is oscillating at a rate exceeding about 1 Hertz (Hz, cycles per second) with the amplitude of the heater draft cycles exceeding about 0.25 inches of water (in. $H_2O$), the burner operation begins to become unstable. Thus, as used herein, the term "burner stability value" means a value that is representative of an unstable burner operation. The burner stability value can be represented by a draft function that is characterized as having a cycle time of the oscillations in draft that exceeds 1 Hz with the oscillations of the heater draft exceeding 0.25 inches of water. More typically, the burner stability value at which heater operation becomes unacceptable is when the cycle time of the heater draft oscillations exceed 1 Hz or even exceeds 2 Hz and the amplitude of the heater draft oscillations exceed 0.3 inches of water, and, more typically, it is when the oscillations exceed 0.40 inches of water.

To control the stability of the burner of a fired heater that is being operated to provide a heater draft, the draft is measured over a time period in order to determine the draft function as described above. This measured draft function is then compared to the burner stability value for the particular fired heater apparatus to determine whether the burner is operating under unstable conditions that potentially can lead to a burner flame-out. If the comparison between the draft function and the burner stability value indicates that the fired heater apparatus is operating under unstable burner conditions, adjustments in the operation of the fired heater can be taken in order to return it to a stable operating condition. These adjustments are thus made in response to the difference between the burner stability value that is indicative of unstable furnace or burner operation and the measured draft function.

The response to an unstable operating condition may include merely examining or watching the burner operation to determine if it will flame-out or has flamed-out. However, it is generally desirable to make an adjustment in the operation of the fired heater or the burner, or both, in order to place the operation of the fired heater back into a stable operating condition. Any suitable type or method of adjustment known to those skilled in the art can be made that has the effect of returning the fired heater to an operation in which the burner conditions are stable. Many natural draft fired heaters are equipped with dampers that are placed in the stack of the fired heater, and one approach to adjusting the heater draft is to make an appropriate adjustment in the damper position to thereby provide for a stable burner operation. Another adjustment that can be made in response to an unstable operating condition is make an adjustment in the amount of air that is made available to the burner for burning the fuel that is introduced to the burner. Also, the fuel composition can be adjusted, and the rate at which fuel is introduced to the burner can be adjusted.

Included in one of the embodiments of the invention is the use of a high frequency response time pressure transducer as the measuring means for measuring the draft over a time period and generating a measured output signal that is representative of the actual draft function exhibited by the fired heater. The frequencies of the draft changes expected in a typical fired heater make the use of the high frequency pressure transducer an important feature of the invention. The frequency response of the high frequency pressure transducer should be sufficient to allow for the measurement of the expected draft changes. As noted above, the burner stability value at which heater operation is in an unstable state is typically when the actual draft function is characterized as having draft oscillations exceeding 1 Hz that exhibits amplitudes exceeding 0.25 inches of water. Considering the magnitude of the burner stability values contemplated by the inventive method, the pressure transducer should be capable of measuring drafts of as low as 0.05 inches of water and which exhibit oscillations in draft that are such that the frequency of the oscillations exceed 5 Hz, or exceed 10 Hz, or even exceed 30 Hz.

The measured output signal generated by the draft measuring means can be processed by signal processing means for processing the measured output signal to generate a calculated output signal representative of the root mean square value of the measured output signal. This signal processing means can be any means known to those skilled in the art that may suitably be used to process the measured output signal generated by the draft measuring means to provide the calculated output signal.

In another embodiment of the method of controlling burner stability of a fired heater, the calculated output signal of the signal processing means is compared to a set point signal that is equivalent to a root mean square value of a draft function that is representative of a stable burner operation. The comparison of the calculated output signal and set point signal results in a comparison value that is used to determine whether or not to make adjustments in the operation of the fired heater. Thus, the fired heater is adjusted in response to the comparison value generated by the difference between the calculated output signal and set point signal.

The measured output signal may also be filtered prior to its processing to generate the calculated output signal. Thus, in another embodiment of the invention, the measured output signal is filtered by filter processing means for processing the measured output signal to generate a filtered signal representative of a filtered actual draft function. The filtering means provides for an improvement in the sensitivity of the measurement of the draft by filtering out background noise in the signal. The filtering means can be any means known to those skilled in the art that may suitably be used to process the measured output signal to generate the filtered signal.

Now referring to FIG. 1, presented is a schematic showing fired heater and control system 10. The fired heater and control system 10 includes a fired heater 12 that is preferably a natural draft fired heater. The fired heater 12 includes a radiant section 14, a convection section 16 and a stack or chimney 18. The stack 18 includes a damper 20 that provides means for controlling the heater draft. Operatively installed in the floor of the fired heater 12 is at least one burner 22. Burner 22 is preferably of the type that provides for the emission of low amounts of $NO_x$ during combustion, i.e. a low $NO_x$ burner. Burner 22 defines a combustion zone wherein oxygen and hydrocarbon fuel are burned, and it provides burner means for the combustion of hydrocarbon fuel with oxygen, preferably with a low release of $NO_x$, to thereby release heat.

Typically, the fired heater 12 is a process heater for introducing heat energy into a process stream. For example, a process feedstock passes by way of conduit 24 into the convection section 16 of the fired heater 12. After it passes through the convection section tubes 26, the process feedstock then passes through the radiant section tubes 28 with the heated process feedstock passing from the fired heater 12 by way of conduit 30.

The monitoring and control system includes measuring means 32 for measuring the heater draft of the fired heater 12. The heater draft is the pressure differential between the pressure of the radiant section 14, as measured at the bottom port 34 and atmospheric pressure as measured at the same elevation as bottom port 34. Measuring means 32 can be any suitable conventional measuring device for measuring pressure and pressure differential and which can provide for measuring the pressure differential between the ambient pressure outside the radiant section 14 at port 34 and the pressure inside the radiant section 14 of the fired heater 12 at the bottom port 34.

It is preferred for measuring means 32 to be of the type that is a high speed pressure transducer known to those skilled in the art which can convert the sensed pressure differential to another signal, such as an electrical signal, that is representative of the measured pressure differential. This representative output signal is transmitted by way of signal line 38 to a signal processing device 39 that transforms the pressure differential signal into a signal proportional to the amplitude of the differential pressure cyclic range. This transformed output signal is transmitted by way of signal line 40 to control means or controller 41.

Control means 41 can be any suitable type of controller known to those skilled in the art and can utilize such methods as control by human decision and control by computer. Controller 41 provides control means for comparing the transformed output signal 40 with a known reference value 42 for stable operation.

An essential aspect of the invention is that the signal processing device 39 provides for an analysis of the measured heater draft to yield a draft function that is proportional to the cyclic variations of the heater draft. This draft function is used as a predictor of possible or imminent flame-out of the burner 22. The draft function reflects the oscillations and the amplitude thereof of the heater draft as a function of time. When the draft function is such that the oscillations have an amplitude exceeding 0.25 inches of water when the frequency exceeding a value in the range of from 1 to 10 Hz, an unstable burner condition exists. Control means 41 compares the draft function with the value for a stable burner to thereby provide a differential value that is transferred as an output signal of control means 41 by signal line 44. The operation of the fired heater 12 or the burner 22, or both, is adjusted in response to the output signal transmitted by way of signal line 44 in order to alter the operation thereof so as to provide for a draft function that reflects a stable burner operation.

Shown in FIG. 1 is one method by which the operation of the fired heater 12 may be adjusted to provide for a stable burner operation. Conduit 48 is operatively connected to burner 22 and provides means for supplying fuel to burner 22. Interposed in conduit 48 is fuel control valve 50 for controlling the amount or rate of fuel introduced into burner 22. Fuel control valve 50 can be adjusted in response to the output signal or comparison value transmitted by way of signal line 44 so as to change the operation of the burner 22 by providing more or less fuel to the burner 22 so as to provide for a stable burner condition. Other methods of altering the operation of the fired heater 12 or the burner 22 may also be used to provide for a stable burner condition including, for example, control of the damper 20, control of the amount of air made available to burner 22, change in the fuel composition, or change in the loading of the fired heater 12 by adjusting the amount of process feedstock charged to the fired heater through conduit 24.

Figure 2:
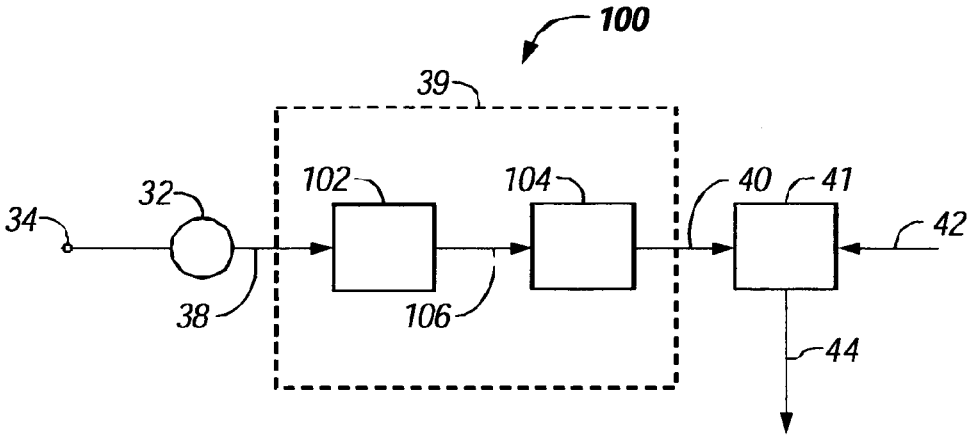
FIG. 2 is a block diagram showing a number of elements of the signal processing device of an embodiment of the invention.

Referring now to FIG. 2, which shows an enlarged detail of certain features depicted in FIG. 1 of signal processing system 100. Further shown are several additional elements not shown in FIG. 1 of the signal processing device 39 of FIG. 1 that are included in one embodiment of the invention. The output signal of measuring means 32 is transmitted through signal line 38 as a measured output signal to signal processing device 39. Signal processing device 39 can further include either a signal filtering means 102 or a signal processing or converting means 104, or both such means 102 and 104, arranged to provide a calculated output signal for transmitting through signal line 40 as an input to control means 41.

The signal filtering means 102 may be any equipment or device known to those skilled in the art for processing or filtering the measured output signal that is transmitted through signal line 38 and generating a filtered signal that is representative of a filtered actual draft function.

The signal processing or converting means 104 may be any equipment or device known to those skilled in the art for converting an input signal to a root mean square value and generating a calculated output signal representative of the root mean square value of the input signal.

In one embodiment of the invention, the measured output signal generated by the draft measuring means 32 is filtered by signal filtering means 102 and the filtered signal is transmitted through signal line 40 as an input to control means 41, whereby it is compared to a known reference value or set point signal 42 that is representative of the point at which the operation of the burner becomes unstable. In another embodiment of the invention, the measured output signal generated by the draft measuring means 32 is transmitted through signal line 38 to signal processing or converting means 104 which processes the measured output signal to generate a calculated output signal representative of the root mean square value of the measured output signal. This calculated output signal is transmitted through signal line 40 as an input to control means 41, whereby it is compared to a known reference value or set point signal 42 that is representative of the point at which the operation of the burner becomes unstable.

In the embodiment illustrated in FIG. 2, the measured output signal generated by measuring means 32 is transmitted through signal line 38 as an input to signal filtering means 102. The filtering means 102 processes the measured output signal and generates a filtered signal representative of the filtered actual draft function that is transmitted through signal line 106 as an input to signal processing or converting means 104. The signal processing or converting means 104 processes the filtered signal and generates a calculated output signal that is representative of the root mean square value of the filtered signal. The calculated output signal is transmitted through signal line 40 as an input to control means 41, whereby it is compared to a known reference value or set point signal 42 that is representative of the point at which the operation of the burner becomes unstable.

It is understood that while particular embodiments of the invention have been described herein, reasonable variations, modifications and adaptations thereof may be made within the scope of the described disclosure and the appended claims without departing from the scope of the invention as defined by the claims.

That which is claimed is:

1. A method of controlling the stability of a low $NO_x$ burner of a fired heater operated to provide a draft pressure, said method comprising:

measuring said draft pressure over a time period;

generating a measured output;

determining a draft pressure function, wherein said draft pressure function defines the relationship between said draft pressure and a time during said time period;

defining a burner stability value for said low $NO_x$ burner, wherein said burner stability value yields low excess oxygen so as to produce less $NO_x$ while also promoting stable burner operation within said fired heater;

comparing said draft pressure function to said burner stability value; and adjusting the operation of said fired heater when said draft pressure function exceeds said burner stability value.

2. The method of claim 1, wherein said burner stability value is defined as when oscillations in the draft pressure exceed 1 Hertz and have an amplitude exceeding 0.25 inches of water.

3. The method of claim 1, wherein said fired heater is a natural draft fired heater.

4. The method of claim 1, wherein in said comparing step, said draft pressure function exceeds said burner stability value when a frequency and an amplitude of said draft pressure function exceed those of said burner stability value.

5. The method of claim 1, wherein said draft pressure is measured by a high frequency response time pressure transducer.

6. The method of claim 1, wherein said fired heater is adjusted by a changing the position of a damper.

7. The method of claim 1, wherein said fired heater is adjusted by a changing an amount of oxygen available to said low $NO_x$ burner.

8. The method of claim 1, wherein said fired heater is adjusted by a changing a rate at which fuel is introduced to said low $NO_x$ burner.

9. A method, comprising:

providing a fired heater equipped with a low $NO_x$ burner and operated to provide a draft pressure;

measuring said draft pressure over a time period;

generating a measured draft pressure function representative of an amplitude of oscillations per unit of time of said draft pressure during said time period;

generating a set point draft pressure function representative of the point at which the operation of said low $NO_x$ burner becomes unstable, wherein said instability may lead to said low $NO_x$ burner flame-out;

comparing said measured draft pressure function to said set point draft pressure function to provide a comparison value; and adjusting the operation of said fired heater in response to said comparison value, wherein said adjustment causes said low $NO_x$ burner to operate in a stable burner condition with low excess oxygen so as to produce less $NO_x$.

10. The method of claim 9, wherein said set point draft pressure function has characteristics exhibiting oscillations that exceed 1 Hertz and have an amplitude exceeding 0.25 inches of water.

11. The method of claim 9, wherein said fired heater is a natural draft fired heater.

12. The method of claim 9, wherein in said comparing step said comparison value is provided when a frequency and an amplitude of said measured draft pressure function exceeds those of said set point draft pressure function.

13. An apparatus for controlling the stability of a low $NO_x$ burner of a fired heater operated to provide a draft pressure, said apparatus comprising:

means for measuring said draft pressure over a time period;

means for generating a measured output;

means for determining a draft pressure function, wherein said draft pressure function defines a relationship between said draft pressure and a time during said time period;

means for comparing said draft pressure function to a burner stability value for said low $NO_x$ burner to determine a comparison value, wherein said burner stability value yields low excess oxyen so as to produce less $NO_x$ while also promoting stable burner operation within said fired heater; and means for adjusting the operation of said fired heater in response to said comparison value.

14. An apparatus, comprising:

a fired heater equipped with a low $NO_x$ burner and operated to provide a draft pressure;

means for measuring said draft pressure over a time period;

means for generating a measured draft pressure function representative of an amplitude of a draft pressure oscillation of said draft pressure during said time period;

means for generating a set point draft pressure function representative of the point at which the operation of said low $NO_x$ burner becomes unstable, wherein said instability may lead to said low $NO_x$ burner flame-out;

means for comparing said measured draft pressure function to said set point draft pressure function to provide a comparison value; and means for adjusting the operation of said fired heater in response to said comparison value, wherein said adjustment causes said low $NO_x$ burner to operate in a stable burner condition with low excess oxygen so as to produce less $NO_x$.

15. A method of controlling the stability of a low $NO_x$ burner of a fired heater operated to provide a draft pressure, said method comprising:

measuring said draft pressure over a time period;

generating a measured output signal representative of a draft pressure function that defines the relationship between said draft pressure and time during said time period;

processing said measured output signal to generate a calculated output signal representative of a root mean square value of said measured output signal;

defining a set point signal representative of the point at which the operation of said low $NO_x$ burner becomes unstable, wherein said instability may lead to said low $NO_x$ burner flame-out;

comparing said calculated output signal to said set point signal to generate a comparison value; and adjusting the operation of said fired heater in response to said comparison value, wherein said adjustment causes said low $NO_x$ burner to operate in a stable burner condition with low excess oxygen so as to produce less $NO_x$.

16. An apparatus for controlling the stability of a low $NO_x$ burner of a fired heater operated to provide a draft pressure, said apparatus comprising:

draft pressure measuring means for measuring said draft pressure over a time period and generating a measured output signal representative of a draft pressure function that defines the relationship between said draft pressure and time during said time period;

calculating means for processing said measured output signal to generate a calculated output signal representative of a root mean square value of said measured output signal;

means for comparing said calculated output signal to a set point signal to generate a comparison value, wherein said set point signal is representative of a point at which the operation of said burner becomes unstable, wherein said instability may lead to said low $NO_x$ burner flame-out; and means for adjusting the operation of said fired heater in response to said comparison Value, wherein said adjustment causes said low $NO_x$ burner to operate in a stable burner condition with low excess oxygen so as to produce less $NO_x$.

17. An apparatus for controlling the stability of a low $NO_x$ burner of a fired heater operated to provide a draft pressure, said apparatus comprising:

draft pressure measuring means for measuring said draft pressure over a time period and generating a measured output signal representative of a draft pressure function that defines the relationship between said draft pressure and time during said time period;

filtering means for processing said measured output signal to generate a filtered signal representative of a filtered draft function;

calculating means for processing said filtered signal to generate a calculated output signal representative of the root mean square value of said filtered signal;

means for comparing said calculated output signal to a set point signal to generate a comparison value, wherein said set point signal is representative of the point at which the operation of said burner becomes unstable, wherein said instability may potentially lead to said low $NO_x$ burner flame-out; and means for adjusting the operation of said fired heater in response to said comparison value, wherein said adjustment causes said low $NO_x$ burner to operate in a stable burner condition with low excess oxygen so as to produce less $NO_x$.

* * * * *